United States Patent [19]

Humphrey

[11] 4,138,095

[45] Feb. 6, 1979

[54] ROADWAY BARRIER

[76] Inventor: Donald F. Humphrey, 2601 Mason St., Wheaton, Md. 20902

[21] Appl. No.: 819,348

[22] Filed: Jul. 27, 1977

[51] Int. Cl.[2] ..... E01F 3/00

[52] U.S. Cl. ..... 256/64; 256/1; 404/6

[58] Field of Search ..... 256/13.1, 1, 64; 116/63 P; 404/6, 7, 9, 10

[56] References Cited

U.S. PATENT DOCUMENTS

| | | | |
|---|---|---|---|
| Re. 18,848 | 5/1933 | Moore | 256/13.1 |
| 2,279,942 | 4/1942 | Hausherr | 256/13.1 |
| 3,127,870 | 4/1964 | Bieber | 256/13.1 UX |
| 3,288,440 | 11/1966 | Schimmelpenninck et al. | 256/13.1 |
| 3,863,899 | 2/1975 | Werner | 256/1 X |
| 3,877,681 | 4/1975 | Humphrey | 256/1 X |

*Primary Examiner*—Andrew V. Kundrat
*Attorney, Agent, or Firm*—Shlesinger, Arkwright, Garvey & Dinsmore

[57] ABSTRACT

A portable, temporary roadway barrier for placement alongside a highway to visually direct and, when necessary, to physically control, automotive traffic.

16 Claims, 6 Drawing Figures

ROADWAY BARRIER

BACKGROUND OF THE INVENTION

This invention is a portable, temporary, roadway barrier for placement at highway construction sites or such other areas in need of temporary redirection of vehicular traffic.

Temporary road barriers have been commonly used at highway construction sites for the purpose of directing and controlling automotive traffic during construction, which barriers are removed when construction is completed. These road barriers are separate and distinct from permanent type barriers such as formed metal guard rails, poured-in-place concrete median barriers and traffic attenuators used proximate bridge abutments, all of which barriers are permanently affixed as an integral part of the highway.

The temporary road barriers are commonly placed along the edges of the highway during road construction and are intended to visually direct, and, if struck, physically redirect the striking vehicle back onto the highway, and prevent the vehicle from entering the construction area. These barriers are conventionally made from timbers, each of which comprises a 10 by 10 inch square log base member which is usually 8 to 10 feet long. A barricade is mounted on the base member and comprises spaced 4 by 4 inch upright posts which support three spaced 2 by 6 inch horizontal rails. Such barriers have proven ineffective in use and, in many instances, very dangerous, causing damage to a striking vehicle and inflicting injury on occupants in the vehicle and construction workers along the side of the roadway.

It has been found that vehicles striking these barriers tend to vault the base member and demolish the barricade, the vehicle becoming impaled on the parts of the barricade or crashing through the same with resultant injury or death to those in the area. In addition, the undercarriages of the vehicle have been seriously damaged in many instances.

The wooden barrier not only fails in its intended purpose but, due to its tremendous mass and bulk, is extremely difficult to move, and cannot be manhandled. Therefore, heavy equipment is required to relocate or align such barriers.

As a result of the above problems, the U.S. Government, through the Department of Transportation, issued an order on Feb. 2, 1977 prohibiting the use of timber barricades on direct Federal or Federal-aid projects.

SUMMARY OF THE INVENTION

The present invention is a temporary roadway barrier which is designed to insure reasonable safety, while at the same time directing and controlling automotive traffic, in the area of highway construction sites.

The present barrier includes a base member comprising an elongated, hollow, parallelepided container adapted to receive ballast for increased weight. The road-facing wall of the container is angularly disposed to the roadway in a manner that the upper limit thereof overhangs the same and the top and bottom walls are parallel with respect to each other and to the ground. By virtue of the hollow, lightweight construction of the container, it is readily portable from place to place manually when not filled.

The present invention further includes a superstructure which is detachably connected with the base member, and which is not constructed to stop vehicles striking the same, but rather serves as a visual aid to drivers to indicate the presence of the barricade. Accordingly, the barricade incorporates a safety feature of breakaway points and specially designed rails to obviate the spearing effect heretofore encountered with barriers of this type.

In order to dampen the impact of the vehicle when it strikes the present barrier, specially designed impact shields are engaged with the roadway-facing wall of the base member.

A specially designed base retainer receives the barrier and supports the barricade. The retainer is designed to be spring loaded when mass in the form of ballast is added to the barrier.

DESCRIPTION OF THE INVENTION

Figure 2:
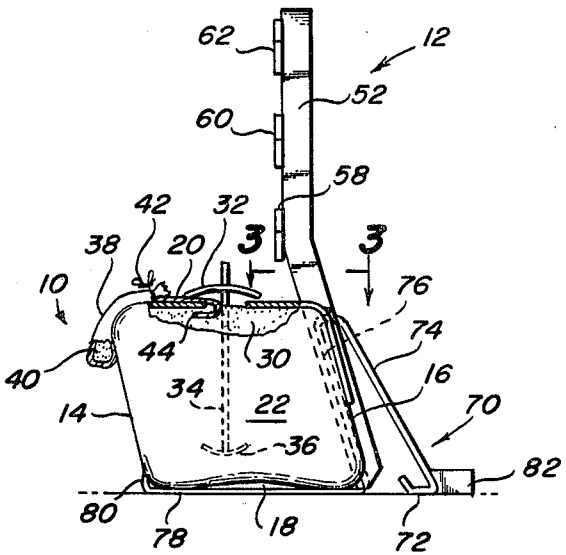
FIG. 2 is an end elevational view of the same.
Figure 3:
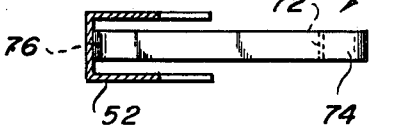
FIG. 3 is an enlarged sectional view substantially along the line 3—3 of FIG. 2 looking in the direction of the arrows.

The portable barrier of the present invention is preferably 8 to 10 feet in length, 24 to 30 inches in height, and includes a base member 10 on which may be mounted a barricade designated 12.

Base member 10 comprises an elongated body of parallelepided shape preferably made of an impact-resistant sturdy plastic such as one of the polyolefins, i.e., polyethylene, polypropylene or an acrylonitrile-butadiene styrene resin of the class commonly known as an ABS resin. The base member includes a front wall 14, a rear wall 16, a bottom wall 18, a top wall 20 and end walls 22 and 24.

As shown to advantage in FIG. 2, front wall 14 and rear wall 16 are parallel and angularly disposed to the vertical, the front wall extending forwardly so that the upper portion thereof overhangs the highway. In this way, contact of the vehicle with the base member will be confined to the upper portion of the front wall. Although a range of angular relationship may be employed, the stability of the base member must be maintained and an angle of 20° or less with respect to a line extending from bottom wall 18, is recommended. An angle of 17° achieves optimum results.

Top wall 20 is provided with an elongated longitudinal opening 26 affording access to a reservoir 28 into which ballast 30 is placed in order to add mass to the base member. Ballast 30 may be of suitable liquid, solid or granular material, or a mixture thereof, sand or chipped blue stone having been found to produce optimum results.

In connection with longitudinal opening 26, there is provided a complemental elongated cover 32 which is preferably of concavo-convex cross section in order to shed water or the like. Cover 32 serves as a relief hatch which is intended to be forced upwardly by ballast 30 upon impact of a vehicle with the base member.

In order to maintain cover 32 in position so that it will remain over opening 26, there are provided spaced, vertical rods 34 extending upwardly from the base member through longitudinal opening 26. Each rod 34 is held in position by a concavo-convex dishlike plate 36 which is preferably adjustable longitudinally of the rod to locate the plate at any desired point for engagement by the ballast to hold the rod in position. The upper end of each rod 34 extends through a complemental opening in cover 32 to hold the cover in position over the longitudinal opening during normal use.

Figure 1:
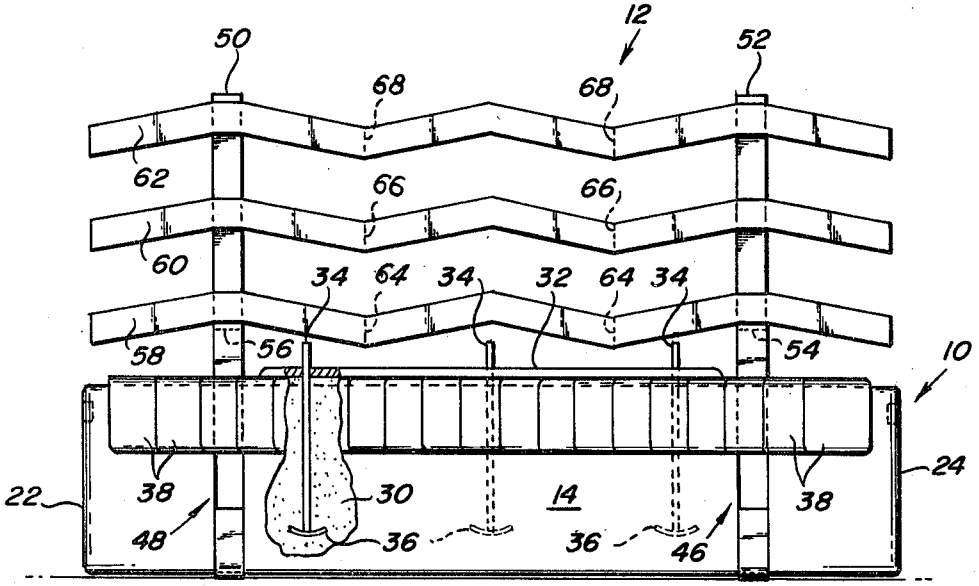
FIG. 1 is a front elevational view of a road barrier constructed in accordance with the present invention.
Figure 6:
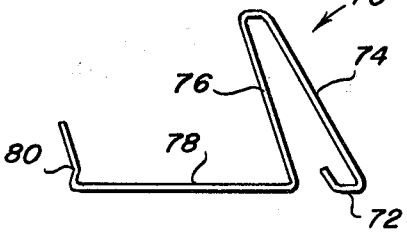
FIG. 6 is a side elevational view of a base stand in compression forming a part of the present invention.
Figure 4:
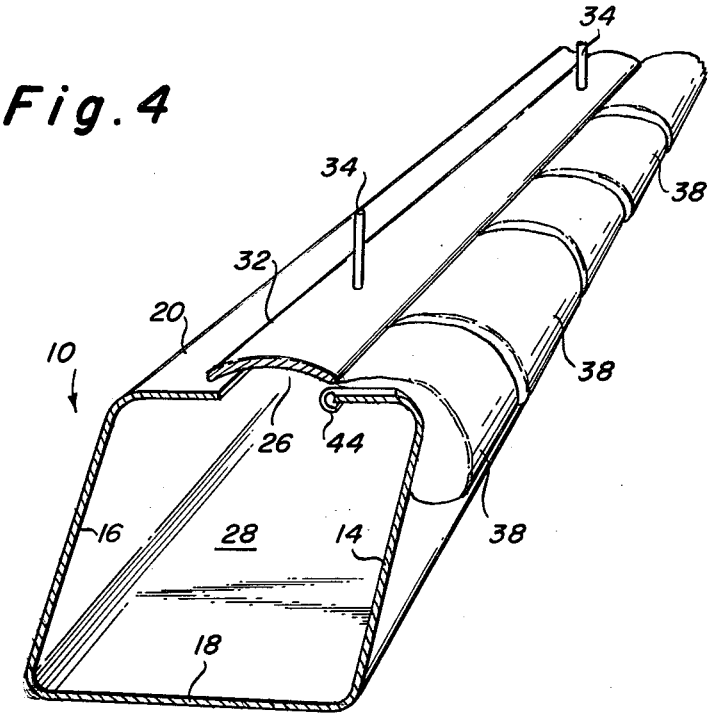
FIG. 4 is a sectional perspective view of a base member forming a part of the present invention.
Figure 5:
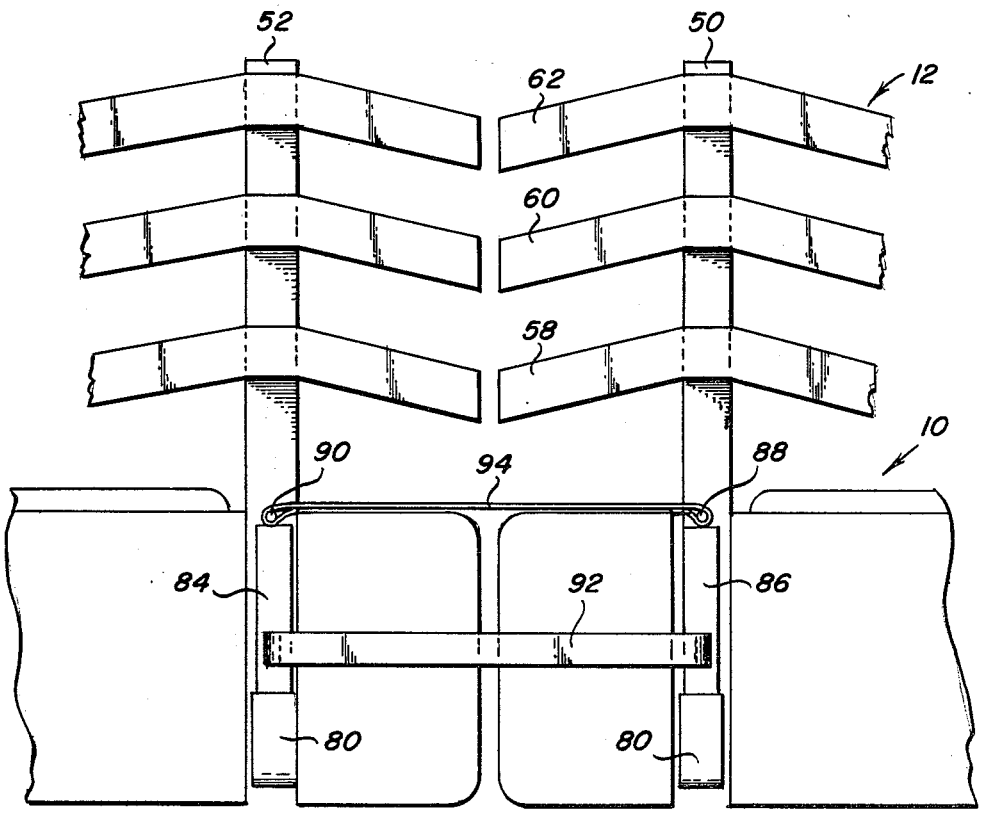
FIG. 5 is a fragmentary front elevational view illustrating the matter of connecting two barriers together.

As further shown in FIGS. 1 and 2, the upper front edge of each base member is protected by a plurality of impact shields 38 comprising multiple baglike members of plastic, cloth or other suitable flexible construction. Shields 38 are filled with any desired impact material 40 which is preferably sand or other granular substance. One end of each shield 38 is held together by a closure 42 and a hook or bill 44 engaged with the closure extends over a longitudinal edge of top wall 20 defining opening 26. It will be noted from FIG. 1 that impact shields 38 are arranged in an overlapping relationship in the direction of travel of vehicles so that, when struck by a vehicle, the impact shield will be dislodged and slide over adjacent shields so that the automobile is deflected, rather than becoming embedded in the wall of the base member.

Each base member 10 is provided with a pair of like, peripheral recesses designated 46 and 48, which recesses are located adjacent the end terminals of the base member for purposes which will be hereinafter more fully set out.

Superstructure or barricade 12 comprises a pair of spaced hollow plastic posts 50 and 52, the lower portion of each of which is of channel shape and angularly disposed for positioning in that portion of peripheral recesses 46 and 48 defined by angular rear wall 16. The upper portion of posts 50 and 52 lie in a vertical plane when the barricade is in position of use. Since the barricade 12 of the present invention is intended to serve a visual, and not a structural function, posts 50 and 52 are provided with transverse weakened zones 54 and 56 located at the juncture between the vertical and angular portions thereof in order to effect ready breaking of the posts at this point in order to prevent damage to vehicles and injury to the vehicle occupants and workers in the event that the barricade is struck.

Barricade 12 further includes a plurality of wavy or undulating rails 58, 60 and 62, each of which is provided with spaced transverse weakened zones which are designated 64, 66 and 68. It will be noted from a consideration of FIG. 1 that, in accordance with one of the objectives of the present invention, those portions of rails 58, 60 and 62 located at the terminals of the rails and those adjacent perforations 64, 66 and 68 extend downwardly at an angle of approximately 15°. In this way, when a sudden and severe force is exerted on the rail ends, breakage will occur along weakened zones 64, 66 and 68, and the pieces thereof are deflected and will not spear the vehicle or occupants before falling to the ground.

The component parts of barricade 12 may be made of any suitable plastic material, such as polypropylene in a color which is highly visible, e.g., yellow or white, which plastic material lends itself to being molded in the desired shape of the posts and rails with their respective weakened portions therein.

In order to maintain barricade 12 in operative engagement with base member 10, there is provided a stand 70 made of structural plastic, such as fiberglass, steel or other suitable strong material. Stand 70 includes a ground engaging foot 72 which issues into an upwardly and angularly extending portion 74. Portion 74 is substantially the height of base member 10, at which point it is reversely curved to provide an angular part 76 which engages the cross piece of the channel-shaped angular portion of post 50 or 52 and forces the same against that portion of rear wall 16 defining peripheral recess 46 or 48. At a point substantially uniplaner when in compression, with foot 72, stand 70 extends forwardly of the base member to provide a portion 78 which lies within that portion of recess 46 or 48 defined by bottom wall 18.

The forward terminal of portion 78 is bent upwardly to provide a front wall-engaging portion 80 lying within a portion of peripheral recess 46 or 48 in front wall 14.

By virtue of its construction, stand 70 is when weighted in compression for better engagement with base member 10 and for greater resistance upon impact by a vehicle.

The ground-engaging portions of stand 70 are preferably provided with an anti-friction coating of a silicone base material to counteract slippage. In order to further prevent movement of the stand and base member, any suitable means such as a kick plate 82 may be engaged with the rear portion of foot 72.

In order to positively prevent movement of the present barriers, it is further within the contemplation of this invention to provide means for securing adjacent barriers together in tandem in order to increase the resistance of each individual barrier to movement. For this purpose, there are provided belts 84 and 86 which are wrapped around adjacent base member 10 within annular recesses 40 and 42, the ends of which belts are secured together in any suitable fashion. Belts 84 and 86 may be made of any flexible strong material such as fabric and plastic. Belts 84 and 85 are provided with a plurality of loops indicated at 88 and 90 respectively, the loops being so located that they lie along at least two different wall portions of the base member.

In conjunction with the belts and loops, there are provided connecting belts indicated at 92 and 94 which extend between loops 88 and 90, the ends of which belts are tightly secured together to establish a strong connection between the base members. Three such connection belts are provided to join the adjacent base member.

In use of this invention, the base member is placed along the edge of the highway, after which ballast is added thereto through opening 26 and barricade 12 is affixed to the base member. The barrier is then in position to control traffic, the base member 10 serving to physically carry out this purpose, and the barricade 12 being a visual aid to the driver to indicate to him the location of the barrier.

In the event that a vehicle comes into contact with the barrier, the height of base member 10, and more particularly the front wall thereof, contacts the front bumper and/or fender of the vehicle, depending upon the angle at which the vehicle approaches the barrier. In view of the angularity of front wall 14, the vehicle strikes the upper portion thereof, and the force thereof is partially absorbed by impact shields 38 which, by virtue of their arrangement in overlapping relationship in the direction of traffic, are moved longitudinally of the base member to absorb the impact of the vehicle. At this time, stand 70 is in compression from the mass of the ballast, so that the base member is fixedly held in position and this fact, coupled with the connection of adjacent base members in tandem maintains the car on the roadway. Since the wheels of the automobile do not strike the base member, the vehicle will not ride up over the barrier but will remain on the roadway.

When the vehicle impacts against the base member, the ballast within the same is forced upwardly through opening 26, thereby lifting cover 32.

In the event that any portion of the vehicle or any other object strikes barricade 12, then, by virtue of the weakened zones in the posts and rails, breakage will occur and the barricade will fall to the ground without harm to the vehicle or individual in the vehicle or in the area.

The present invention provides a temporary roadway barrier wherein the base member thereof is movable from place to place manually before the ballast is placed therein, and wherein the barricade or superstructure thereof may be readily applied to the base member without the use of tools. By virtue of the detachable engagement of the base member with the barricade, the base member may be employed by itself, if desired, in a situation where the visual barricade is not needed. Furthermore, the barricade may also be readily replaced in the event of damage.

In view of the plastic construction of the components parts of the present invention, the cost of manufacture thereof is competitive with previously used timber products.

While there has been herein shown and described the presently preferred form of this invention, it is to be understood that such has been done for purposes of illustration only and that various changes may be made therein within the scope of the appended claims.

What is claimed is:

1. A temporary barrier for use on roadways comprising:

(a) a base member including an elongated body having front, rear, top, bottom and end walls,
(b) said elongated body being hollow to provide a reservoir,
(c) ballast,
(d) opening means in said body for adding said ballast to the reservoir,
(e) the front wall of said elongated member being disposed at an angle to the vertical so that the upper limit thereof projects over the roadway in advance of the remainder of the front wall,
(f) the elongated body being of a height that the projecting upper portion thereof engages the bumper or fender of the vehicle, whereby the striking force of the vehicle is distributed over a substantial portion of the length of the elongated body,
(g) a plurality of impact shields positioned on the projecting portion of the front wall of said base member to absorb the force of the vehicle striking the same, and
(h) means for detachably engaging said impact shields with said base member.

2. The barrier of claim 1, wherein:

(a) said impact shields are arranged in longitudinally overlapping relationship.

3. A temporary barrier for use on roadways comprising:

(a) a base member including an elongated body having front, rear, top, bottom and end walls,
(b) said elongated body being hollow to provide a reservoir,
(c) ballast,
(d) opening means in said body for adding said ballast to the reservoir,
(e) the front wall of said elongated member being disposed at an angle to the vertical so that the upper limit thereof projects over the roadway in advance of the remainder of the front wall,
(f) the elongated body being of a height that the projecting upper portion thereof engages the bumper or fender of the vehicle whereby the striking force of the vehicle is distributed over a substantial portion of the length of the elongated body,
(g) a barricade comprising upright and cross members positioned proximate the rear wall of said base member,
(h) said base member being provided with peripheral recesses adjacent the terminals thereof,
(i) stands positioned proximate the rear wall of said base member in the area of peripheral recesses,
(j) each of said stands having a portion detachably engaged with an upright member and urging the same into that part of the peripheral recess formed in the rear wall.

4. The temporary barrier of claim 3, with the addition of:

(a) means engageable with said stand for preventing movement of said stand and base member when the latter is impacted by a vehicle.

5. A temporary barrier for use on roadways comprising:

(a) a base member including an elongated body having front, rear, top, bottom and end walls,
(b) said elongated body being hollow to provide a reservoir,
(c) ballast,
(d) a longitudinal opening in the top wall of said base member through which said ballast is added to the reservoir,
(e) a complemental cover placed over the longitudinal opening of said top wall,
(f) a plurality of spaced, vertical rods extending through the longitudinal opening in the top wall of said base member,
(g) said rods extending through complemental openings in said cover, and
(h) means for retaining said rods in stationary position relative to said elongated body.

6. The temporary barrier of claim 5, wherein:

(a) said means for retaining each of said rods in position comprises a dishlike member affixed to the rod,
(b) said dishlike member being embedded in, and held by, said ballast.

7. A temporary barrier for use on roadways comprising:

(a) a base member including an elongated body having front, rear, top, bottom and end walls,
(b) said elongated body being hollow to provide a reservoir
(c) ballast,
(d) opening means in said elongated body for adding ballast to the reservoir, (e) the front wall of said elongated body being disposed at an angle to the vertical so that the upper limit thereof projects over the roadway in advance of the remainder of the front wall, said front wall extending at an angle which does not exceed 20° to a line which is an extension of said bottom wall, and (f) detachable impact shield means carried by the projecting portion of said front wall for absorbing the force of a vehicle striking the same.

8. The temporary barrier of claim 7, wherein:

(a) said means carried by the projecting portion of the front wall of said base member comprises impact shields, and (b) means for detachably engaging said impact shields with said base member.

9. The temporary barrier of claim 8, wherein:

(a) said impact shields are arranged in longitudinally overlapping relationship.

10. The temporary barrier of claim 7, with the addition of:

(a) a barricade comprising upright and cross members positioned proximate the rear wall of said base member, and (b) means for removably engaging said barricade with said base member.

11. The temporary barrier of claim 10, wherein:

(a) said means for removably engaging said barricade with said base member comprises stands, (b) said base member having recess means for receiving the upright members of said barricade, (c) each of said stands including means for forcing the upright members of said barricade against that portion of the base member defining said recess means.

12. A temporary barrier for use on roadways comprising:

(a) a weighted base member including an elongated body having front, rear, top, bottom and end walls, (b) the front wall of said elongated member being disposed at an angle to the vertical so that the upper limit thereof projects over the roadway in advance of the front wall, (c) the rear wall of said elongated body being substantially parallel to the front wall of said elongated body, (d) said base member being provided with peripheral recesses adjacent the terminals thereof, (e) a barricade comprising upright and cross members positioned proximate the rear wall of said base member, and (f) stands engaged with said base member and engageable with the cross members of said barricade for holding the same in the peripheral recesses of said base member.

13. The temporary barrier of claim 12, wherein:

(a) each of said stands includes a ground engaging foot, (b) said foot issuing into an upwardly and angularly extending portion of substantially the same height as said base member, (c) said angularly extending portion being reversely curved to provide an angular part which engages the upright member of said barricade and forces the same against that portion of the base member defining a peripheral recess of the base member, (d) said stand further including, at a point uniplanar with said foot, a portion which lies within that portion of the peripheral recess of said base member defined by the bottom wall thereof.

14. The temporary barrier of claim 13 with the addition of:

(a) a kick plate engaged with the foot of said stand for preventing accidental movement thereof.

15. A temporary barrier for use on roadways comprising:

(a) a base member including an elongated body having front, rear, top, bottom and end walls, (b) said elongated body being hollow to provide a reservoir, (c) ballast, (d) opening means in said body for adding said ballast to the reservoir, (e) a barricade comprising upright and cross members positioned proximate the rear wall of said base member, and (f) means for removably engaging said barricade to said base member, (g) said cross members including downwardly extending portions and weakened zones in the area of said downwardly extending portions, whereby, in the event that the barricade is struck, the cross members will break along the weakened zones into small pieces, the ends of which are directed downwardly to prevent damage to vehicles or personal injury.

16. The temporary barrier of claim 15, wherein:

(a) said upright members are provided with transverse weakened zones in order to permit the same to break under forces exerted thereon.

* * * * *